US008272327B2

(12) United States Patent
Machina et al.

(10) Patent No.: US 8,272,327 B2
(45) Date of Patent: Sep. 25, 2012

(54) MULTIPLE DIVERGING PROJECTILE SYSTEM

(75) Inventors: Mark H. Machina, Leesburg, VA (US); Michael Raleigh, Alexandria, VA (US); Kristopher P. Mount, Falls Church, VA (US); Kenneth W. Mitchell, Fredericksburg, VA (US); Michael A. Bohnet, Herndon, VA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 405 days.

(21) Appl. No.: 12/604,018

(22) Filed: Oct. 22, 2009

(65) Prior Publication Data

US 2012/0210902 A1 Aug. 23, 2012

(51) Int. Cl.
*F42B 10/06* (2006.01)

(52) U.S. Cl. ..... 102/473

(58) Field of Classification Search ..... 102/473, 102/474, 501, 372–374; 244/3.3, 3.26, 3.24
See application file for complete search history.

(56) References Cited

U.S. PATENT DOCUMENTS

| | | | | | |
|---|---|---|---|---|---|
| 46,490 | A * | 2/1865 | Orwig | 102/501 |
| 1,277,225 | A * | 8/1918 | Lauesen | 102/384 |
| 2,594,766 | A * | 4/1952 | Goddard | 244/99.1 |
| 3,292,879 | A * | 12/1966 | Saxton | 244/3.3 |
| 4,561,357 | A * | 12/1985 | Maudal et al. | 102/439 |
| 4,579,298 | A * | 4/1986 | Thomson | 244/3.21 |
| 5,080,017 | A * | 1/1992 | Asikainen | 102/372 |
| 5,115,742 | A * | 5/1992 | Frazer | 102/208 |
| 5,139,216 | A * | 8/1992 | Larkin | 244/3.21 |
| 5,708,232 | A * | 1/1998 | Nedderman, Jr. | 114/23 |
| 6,364,248 | B1 * | 4/2002 | Spate et al. | 244/3.23 |
| 6,467,722 | B1 * | 10/2002 | Berry et al. | 244/3.21 |
| 7,262,394 | B2 * | 8/2007 | August | 244/3.3 |
| 7,380,504 | B2 * | 6/2008 | Dryer | 102/520 |

OTHER PUBLICATIONS

David Burns, "Deep Digger Weapons System Development", Medium Caliber Weapons Systems Branch, US Army ARDEC, 41st Annual NDIA Gun and Missile Systems Conference, Sacramento, CA, Mar. 27-30, 2006.

* cited by examiner

*Primary Examiner* — Bret Hayes
*Assistant Examiner* — Reginald Tillman, Jr.
(74) *Attorney, Agent, or Firm* — Rossi, Kimms & McDowell; Marc A. Rossi; Daniel J. Long

(57) ABSTRACT

A system for firing multiple projectiles in a parallel or diverging manner is provided. The system can comprise tail-end portions of projectiles that add structure to a cartridge, provide for efficient combustion, allow projectiles to transition from a straight configuration in the cartridge to a splayed configuration in a chamber, and ensure complete evacuation of the chamber. The system can include a tail-end portion of a particular projectile with openings that distribute energy from combustion of an ignition charge, facilitating firing of multiple projectiles. A tail-end portion of a projectile can include a ball joint upon which the body portion of the projectile moves causing an angle between the body portion and the tail-end portion. A space can exist in the body portion adjacent to the ball joint to allow off-center shifting of the body portion with respect to the ball joint.

14 Claims, 4 Drawing Sheets

MULTIPLE DIVERGING PROJECTILE SYSTEM

STATEMENT OF GOVERNMENT INTEREST

The invention was made with United States Government support under Contract No. W15QKN-04-C-1110 awarded by the Army Research and Development Command (ARDEC). The United States Government has certain rights in this invention.

FIELD OF THE INVENTION

This invention relates to a system and components thereof for firing multiple projectiles in a parallel or diverging manner.

BACKGROUND OF THE INVENTION

FIG. 1 illustrates a conventional drilling gun 100 configured to be inserted into a shaft in which drilling is to occur. The drilling gun 100 includes a chamber 102 into which a cartridge 104 from a magazine 106 is inserted. The cartridge 104 includes a center projectile 108 surrounded by six peripheral projectiles 110. All of the projectiles 108, 110 are parallel to each other when inserted into the chamber. The center projectile 108 fits into a center barrel 112 of the gun 100. The peripheral projectiles 110 respectively fit into the peripheral barrels 114 of the gun 100. The peripheral barrels 114 are curved so as to cause the initially-parallel peripheral projectiles 110 to diverge upon firing of the cartridge 104. The pattern of diverging projectiles caused by the organization and shape of the barrels 112, 114 facilitates drilling.

It is preferable that the cartridge 104 be made of a combustible material that leaves no structural components in the chamber 102 upon firing of the cartridge 104. In this way, the chamber 102 can simply be reloaded from the magazine with another cartridge 104, without having to eject or store a spent cartridge 104, clean out the chamber 102, or remove the gun 100 from the shaft. Combustible cases are commonly used in modern artillery, mortar, and tank rounds. The wall thickness of combustible ordnance is typically such that the combustible material itself provides sufficient structural integrity for the round to withstand usual handling wear and tear. As such, these designs, when chambered, require relatively high pressures to fully eliminate combustion residue.

While there is some precedent for using curved barrels 114 to achieve a diverging projectile pattern, this methodology forces peripheral projectiles 110 to undergo a high G-load turn during launch which induces high stresses on the bodies of the peripheral projectiles that could lead to premature structural failure or premature ignition of the explosive charge within the projectile should it exist.

While the design of the gun 100 in FIG. 1 can be sufficient under certain conditions, it would be desirable to provide a design for repeatedly using combustible cartridges to launch projectiles in a diverging pattern without the requirement for high chamber pressures or without subjecting the projectiles themselves to unnecessarily high stresses during launch. Such a design would provide a safer, more efficient system.

SUMMARY OF THE INVENTION

The above-described problems are addressed and technical solutions are achieved in the art by a system and components thereof for efficiently firing multiple projectiles in a parallel or a diverging manner, according to various embodiments of the present invention. Some of these embodiments allow the multiple projectiles to be fired repeatedly and without the use of curved barrels.

In some embodiments, a projectile includes a body portion and a tail-end portion connected to the body portion. The tail-end portion can be removed from a chamber as the body portion of the projectile is launched upon cartridge firing. The tail-end portion has a smaller cross-sectional area than a cross-sectional area of the body portion. The tail-end portion can have a columnar shape for support, stability, stacking, or combinations thereof, for example. However, other shapes can be used. When at least a portion of the tail-end portion is inserted into an alignment casing of a cartridge, the tail-end portion provides additional structural support, allowing less material to be used in the walls of the alignment casing.

In some embodiments, the body portion of the projectile includes a penetrating nose portion.

In some embodiments, the body portion of the projectile includes explosive material configured to detonate upon impact of the body portion with an object subsequent to combustion of charges in the cartridge.

In some embodiments, the tail-end portion can include openings to distribute energy from an ignition charge. According to this configuration, the tail-end portion, or a portion thereof, can be inserted into an alignment casing of a cartridge that contains a first combustible charge, and combustion energy of the ignition charge can be uniformly distributed to the first combustible charge through the tail-end portion, thereby causing an efficient firing of the cartridge.

In some embodiments, the tail-end portion contains the ignition charge. In embodiments where the tail-end portion is connected to the body portion of the projectile, structural components of the tail-end portion that survive combustion of the ignition charge are removed from the chamber when the body portion of the projectile is launched upon cartridge firing.

In some embodiments, the tail-end portion includes a ball joint upon which the body portion of the projectile moves or rotates causing an angle between the body portion and the tail-end portion. In some embodiments, a space exists in the body portion of the projectile adjacent to the ball joint into which the ball joint translates when the angle between the body portion and the tail-end portion is caused. In some of these embodiments, the body portion is centered on the ball joint when there is no angle between the body portion and the tail-end portion, and, when the ball joint is in the space, the body portion is off-center with respect to the ball joint. In embodiments that include the ball joint, the ball joint can be physically captured by the body portion such that the body portion and tail-end portion remain connected when the angle between the body portion and the tail-end portion is caused. Embodiments that include the ball joint allow a projectile initially oriented parallel to the cartridge axis to reorient as necessary to other features of the gun system.

In some embodiments, the tail-end portion does not include the ignition charge, the openings, or both, but the tail-end portion includes the ball joint or the space adjacent to the ball joint, or both.

In some embodiments of the present invention, a projectile cartridge includes a plurality of projectiles and an alignment casing. The plurality of projectiles each include (a) any embodiment of the body portion described herein and (b) any embodiment of the tail-end portion described herein. The alignment casing encloses a portion of each of the plurality of projectiles and includes a first combustible material or charge. In some embodiments, the ball joint is a portion of the tail-end portion of a projectile that remains outside of (i.e. is not enclosed by) the alignment casing, so that any combustible material in the alignment casing is not disturbed or prematurely ignited by movement on the ball joint. The alignment casing contains features that assist in aligning the plurality of projectiles for ejection in a parallel or diverging manner. In some embodiments, the alignment casing arranges the plurality of projectiles to have a center projectile surrounded by peripheral projectiles.

In some embodiments the alignment casing is made of a second combustible material that completely combusts in a manner that leaves no structural components of the alignment casing in the chamber upon combustion of the second combustible material in conjunction with combustion of the first combustible material. In some embodiments, the first combustible material and the second combustible material are different materials.

In some embodiments, a projectile system includes a barrel system and a projectile cartridge. The barrel system includes multiple barrels extending in a parallel or diverging manner. The projectile cartridge includes an alignment casing and a plurality of projectiles. The alignment casing encloses a portion of each of the plurality of projectiles and includes a first combustible material or charge. The alignment casing contains features that assist in respectively aligning the plurality of projectiles with the barrels of the barrel system when the plurality of projectiles is inserted into the barrels of the barrel system. The plurality of projectiles each include any embodiment of the body portion described herein and any embodiment of the tail-end portion described herein necessary to assist combustion and achieve alignment of the projectiles to their respective barrel in the barrel system.

In an embodiment of the present invention, a projectile system includes a barrel system and a projectile cartridge. The barrel system includes multiple barrels extending in a diverging manner. The projectile cartridge includes an alignment casing and a plurality of projectiles. The alignment casing encloses a portion of each of the plurality of projectiles, includes a first combustible material or charge, and is made of a second combustible material. The alignment casing gains additional structural support from the tail-end portions of the plurality of projectiles. The alignment casing arranges the plurality of projectiles to have a center projectile surrounded by peripheral projectiles. The alignment casing contains features that assist in respectively aligning the plurality of projectiles with the barrels of the barrel system when the plurality of projectiles are inserted into the barrels of the barrel system. The plurality of projectiles each include a body portion and a tail-end portion connected to the body portion. The tail-end portion of the center projectile includes openings that distribute energy passing through the tail-end portion from combustion of an ignition charge contained within the tail-end portion of the center projectile. The distributed energy causes combustion of the first and second combustible material and causes the plurality of projectiles to eject from the barrel system. The tail-end portion of a peripheral projectile includes a ball joint and a space adjacent to the ball joint causing an angle and a translation between the corresponding body portion and the corresponding tail-end portion, allowing the peripheral projectile to fit into its respective barrel of the barrel system and eject therefrom in a diverging manner. As such, a relatively weak alignment casing supported by tail-end portions of projectiles can be used to launch multiple projectiles in a diverging manner while entirely evacuating the chamber and eliminating unnecessary stresses on the projectiles. Further, as discussed above, the ball joint can be a portion of the tail-end portion of the peripheral projectile that is not enclosed by the alignment casing. Such an arrangement can, in some configurations, help prevent premature combustion or other disturbance of any combustible material inside or comprising the alignment casing during actuation of the ball joint.

In addition to the embodiments described above, further embodiments will become apparent by reference to the drawings and by study of the following detailed description.

BRIEF DESCRIPTION OF THE DRAWINGS

The present invention will be further understood from the detailed description of preferred embodiments presented below considered in conjunction with the attached drawings, of which.

It is to be understood that the attached drawings are for purposes of illustrating the concepts of the invention and may not be to scale.

DETAILED DESCRIPTION

The invention is inclusive of combinations of the embodiments described herein.

References to a particular embodiment do not necessarily refer to the same embodiment or embodiments, and particular embodiments are not mutually exclusive, unless so indicated or as are readily apparent to one of skill in the art. The use of singular or plural in referring to an embodiment or embodiments and the like is not limiting. Further, it should be noted that, unless otherwise explicitly noted or required by context, the word "or" is used in this disclosure in a non-exclusive sense.

Figure 2:
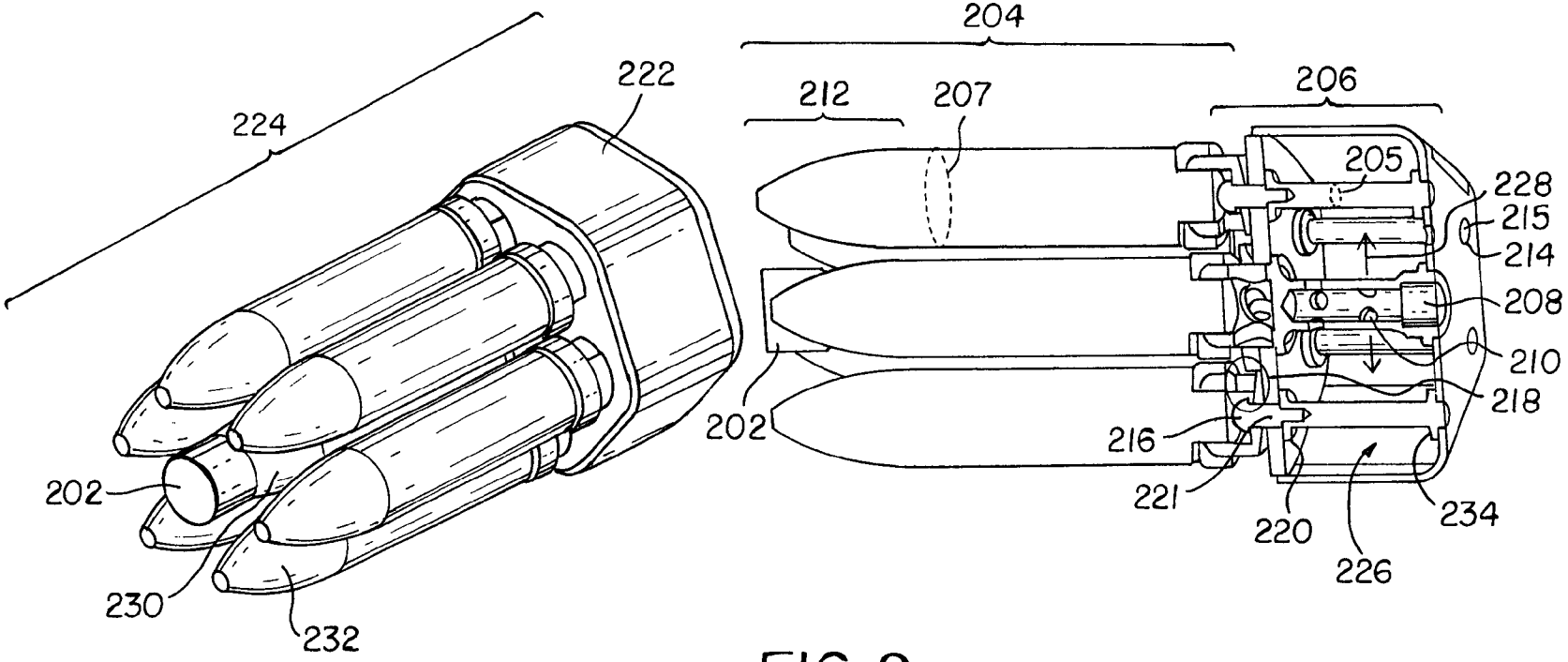
FIG. 2 illustrates a projectile cartridge and projectiles, according to an embodiment of the present invention.
Figure 3:
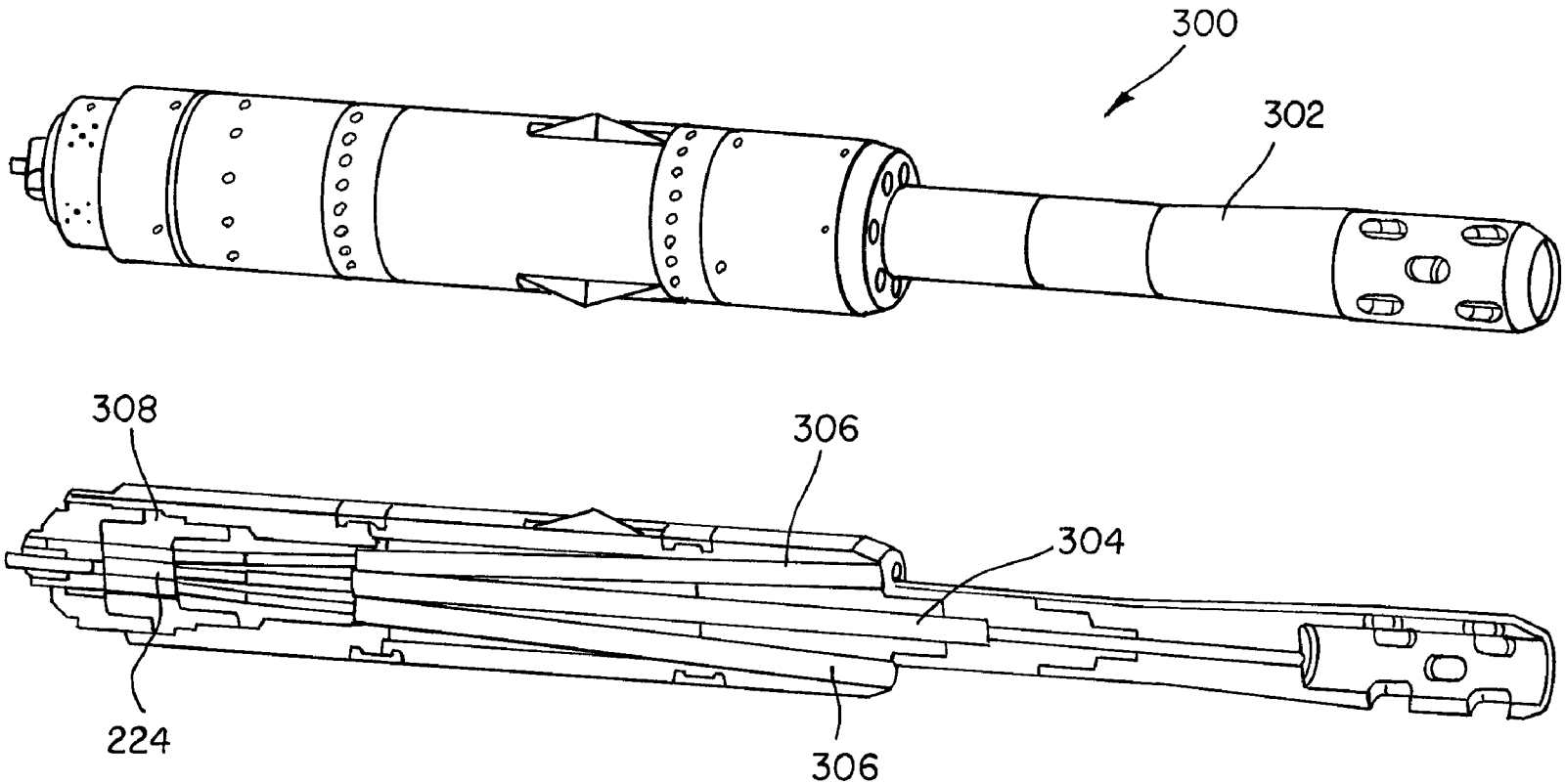
FIG. 3 illustrates a projectile system, according to an embodiment of the present invention.

FIG. 3 illustrates a multiple diverging projectile system 300, according to an embodiment of the present invention. The projectile system 300 includes a barrel system 302 and a projectile cartridge 224. The barrel system 302 includes a chamber 308 into which the projectile cartridge 224 is inserted. The barrel system 302 also includes multiple barrels 304, 306 that extend linearly in a diverging manner. The multiple barrels include a center barrel 304, corresponding to a center projectile 230 (FIG. 2), and a plurality of peripheral barrels 306 respectively corresponding to peripheral projectiles 232 (FIG. 2). Although not required, the embodiment of FIG. 3 has the barrels 304, 306 diverging at an angle of three degrees. Other angles or parallel barrels can be used, depending upon design choice.

An embodiment of the projectile cartridge 224 is shown in detail in FIG. 2. The projectile cartridge 224 includes an alignment casing 222 enclosing a portion of each of a plurality of projectiles 230, 232. The plurality of projectiles 230, 232 includes a center projectile 230 surrounded by a plurality of peripheral projectiles 232. The center projectile 230 can include a cap 202 to facilitate stacking of cartridges 224 in a magazine.

Each of the plurality of projectiles 230, 232 includes a body portion 204 connected to a tail-end portion 206 such that the two portions initially share a common longitudinal axis and the plurality of projectiles are parallel to each other. Because the tail-end portion 206 is connected to the body portion 204, structural components of the tail-end portion that survive firing of the cartridge 224 are removed from the chamber when the body portion 204 is launched upon such firing.

The alignment casing 222 encloses a portion of the tail-end portions 206 of each of the plurality of projectiles 230, 232. The body portions 204 can each include a penetrating nose portion 212. In this embodiment, the tail-end portions 206 span the length of the alignment casing 222 to provide additional structural support to the alignment casing 222. The tail-end portions 206 can feature flanges 234 (FIG. 2 and FIG. 4) at either end of the alignment casing 222 to provide additional support area. The tail-end portion 206 can assume a columnar shape as shown in FIG. 2 where the tail-end portion has a smaller cross-sectional area 205 than a cross-sectional area 207 of the body portion 204, possibly excluding the tip of the penetrating nose portion 212. The cross-sectional areas 205, 207 are perpendicular to the longitudinal axis of the respective body portion 204 and tail-end portion 206, respectively. Such a columnar shape of the tail-end portion 206 can be preferable because such a configuration reduces the volume occupied by the support structure, as compared to other configurations, while retaining sufficient strength to support the alignment casing 222. However, other shapes can be used. In this regard, although round cross-sectional columnar shapes are shown for tail-end portions 206, rectangular or other shaped cross-sectional areas can be used. The structural support provided by the tail-end portions 206 takes some of the structural support requirements away from the alignment casing 222. Therefore, the alignment casing 222 can have a thin-wall, for example, if so desired, due to the tail-end portions 206.

The body portions 204, in some embodiments, include explosive material within them. The explosive material can detonate after impact of the corresponding body portion 204 with an object subsequent to launch and flight of the corresponding projectile.

The tail-end portion 206 of the center projectile 230 is at least partially hollow and includes openings 210 to the hollow area that distribute energy 228 from combustion of an ignition charge. In this case, the energy can come from combustion of an ignition charge 208 that is present in the base of the tail-end portion 206 of the center projectile 230. The distributed energy 228 can be used to combust a first combustible material or charge in the internal region 226 of the alignment casing 222, as well as the alignment casing 222 itself when it is composed of a second combustible material, thereby causing firing of all of the projectiles 230, 232.

Figure 4:
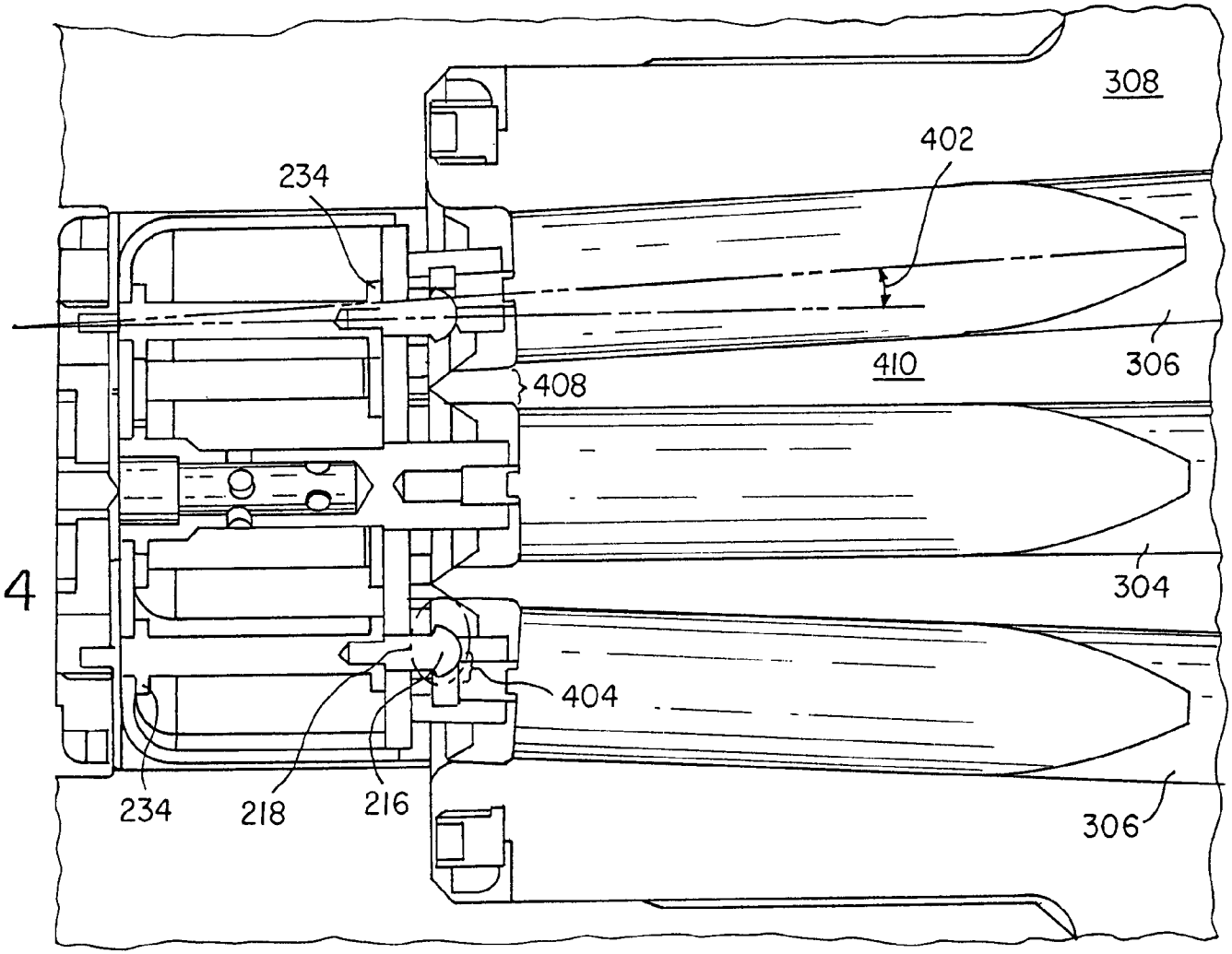
FIG. 4 illustrates pivoting and translation of a projectile body portion on a ball joint, according to an embodiment of the present invention.

The tail-end portions 206 of the peripheral projectiles 232 can be solid, as compared to the at least partially hollow tail-end portion 206 of the center projectile 230. Also, each of the tail-end portions 206 of the peripheral projectiles 232 can include a ball joint 216 upon which the corresponding body portion 204 can move (e.g., rotate or translate) causing an angle 402, as shown in FIG. 4, between the body portion 204 and the corresponding tail-end portion 206. FIG. 2 shows an arrangement where no action has occurred to cause the body portions 204 and tail-end portions 206 to deviate from their initial state of sharing a common longitudinal axis. In the state shown in FIG. 2, the body portions 206 of the peripheral projectiles 232 are centered or substantially centered on the corresponding ball joints 216.

Each of the tail-end portions 206 of the peripheral projectiles 232 can also include a space 218, shown in FIGS. 2 and 4, in the body portion 204 adjacent to the ball joint 216. When the angle 402 between the body portion 204 and the tail-end portion 206 is caused, the ball joint 216 becomes located, by translation, in the space 218, as shown in FIG. 4. Consequently, as the ball joint 216 translates into the space 218, the body portion 402 becomes off-centered 404 with respect to the ball joint 216. This feature reduces rotation resistance and allows an initial bolt circle of the peripheral projectiles 232 (i.e., a circle with a circumference that passes through the central longitudinal axis of each of the peripheral projectiles 232 in an initial, parallel, non-splayed orientation) to be smaller than the bolt circle of the peripheral barrel 306 openings (i.e., a circle with a circumference that passes through the central longitudinal axis of each of the peripheral barrels 306), resulting in a thicker webbing 408 between barrel 304, 306 openings. This webbing or dividing region 410 continues to enlarge as the barrels further diverge. Accordingly, such space 218, in conjunction with the ball joint 216, allows the peripheral projectiles 232 to fit into respective diverging barrels 304, 306 so that such projectiles can be ejected therefrom in a diverging manner.

The alignment casing 222 contains features that determine the initial spacing, location and alignment of the plurality of projectiles. An example of such a feature is holes 214 machined in the tail-end-most surface (e.g., the surface furthest from the body portion 204) of the alignment casing 222 for insertion of correspondingly-shaped boss features 215 of the tail-end portions 206 of the projectiles (e.g., peripheral projectiles 232). These holes 214 and corresponding boss features 215 serve to provide spacing and location for a tail-end portion 206. Another example is holes 220 machined into the leading surface (e.g., the surface closest to the body portion 204) of the alignment casing 222 for insertion of a correspondingly shaped portion (e.g., leading column head portion 221) of the tail-end portions 206 of the projectiles (e.g., peripheral projectiles 232). These corresponding holes 220 and portions 221 of the tail-end portions 206 provide spacing, location, and alignment of the inserted tail-end portions 206.

The alignment casing 222 includes an interior region 226 in which a first combustible material or charge can be inserted. The alignment casing 222 can itself be made of a second combustible material that completely combusts in a manner that leaves no structural components of the alignment casing in the chamber 308 upon combustion of the second combustible material in conjunction with combustion of the first combustible material.

Any ball joint 216 can be a portion of the corresponding tail-end portion 206 of a projectile that is not enclosed by the alignment casing 222. Such an arrangement can, in some configurations, help prevent premature combustion or other disturbance of any combustible material inside or comprising the alignment casing during actuation of the ball joint 216.

Figure 1:
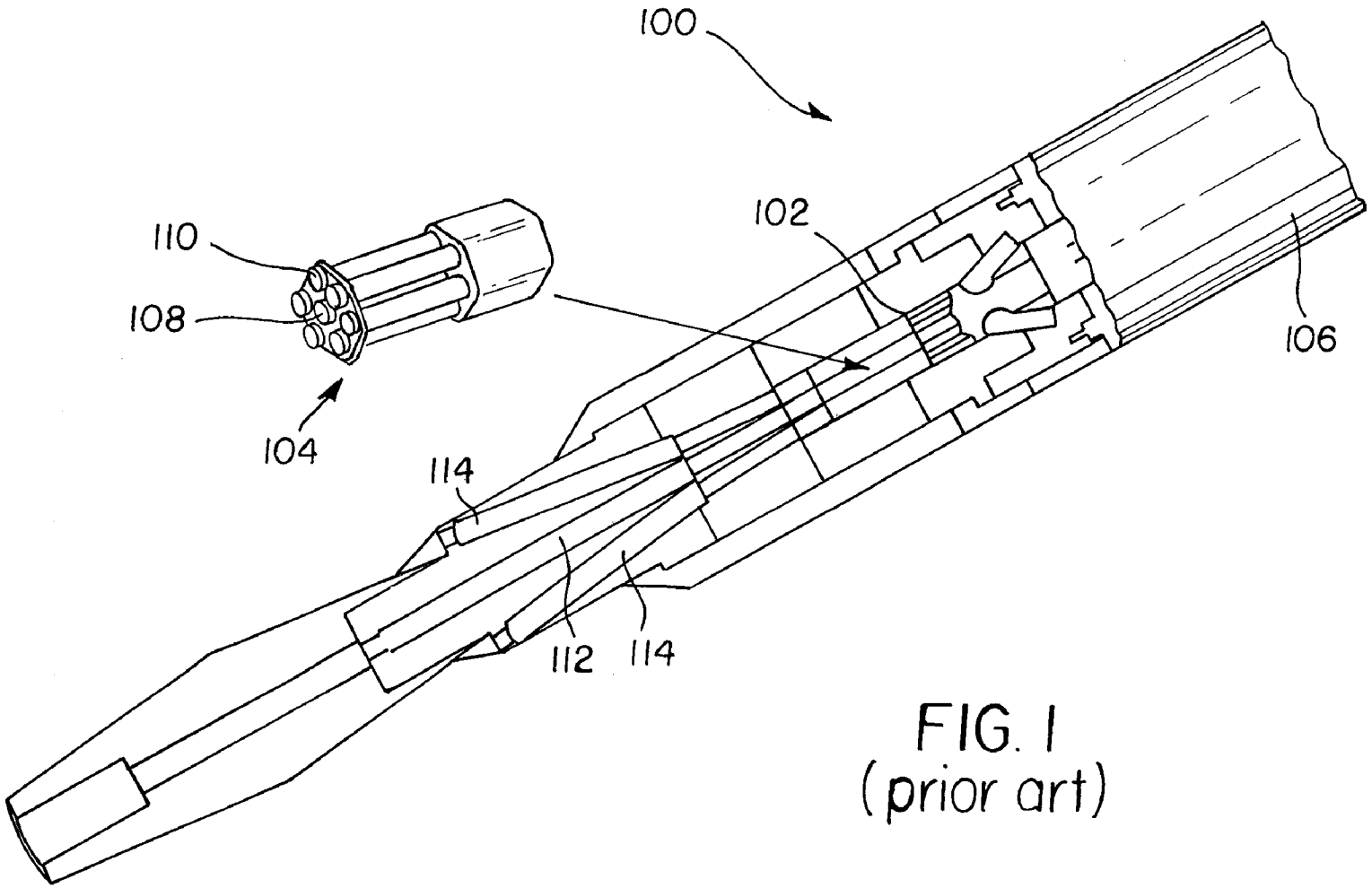
FIG. 1 (prior art)
FIG. 1 illustrates a conventional drilling gun.

The alignment casing 222 respectively aligns the plurality of projectiles 230, 232 with the barrels 304, 306 of the barrel system 302 when the plurality of projectiles 230, 232 is inserted into the barrels 304, 306 of the barrel system 302. This alignment is accomplished by both the exterior shape of the alignment casing 222, which could be hexagonal, and the aforementioned interior features of the alignment casing 222 that determine the initial spacing, location and alignment of the plurality of projectiles 230, 232. Unlike the conventional drilling gun 100 in FIG. 1 that has curved peripheral barrels 114 in order to cause parallel-aligned projectiles to diverge, the ball joint 216 and the space 218, according to various embodiments of the present invention, allow the projectiles 230, 232 to be aligned with linear, diverging barrels. Accordingly, the projectiles transition from a straight configuration in the cartridge 224, to a splayed configuration in the chamber 308. Achieving projectile splay during chambering is more desirable than forcing the projectiles to negotiate a high G-load turn during launch, as occurs in the curved-barrel configuration of the conventional drilling gun 100.

In embodiments where the ignition charge 208 is located in the tail-end portion 206 of the center projectile 230, the interior region 226 includes a first combustible material or charge, and the alignment casing 222 is formed of a second combustible material, combustion of the ignition charge 208 distributes energy through openings 210, causing combustion of both the first combustible material in the internal region 226 and the alignment casing 222 itself. This combustion process ejects the projectiles 230, 232 through the diverging barrels 304, 306 and, consequently, from the barrel system 302 in a diverging manner. Since the alignment casing 222 itself combusts and the tail-end portions 206 remain attached to the ejected body portions 204, the chamber 308 is completely evacuated of all structural components and combustion residue, even at relatively low pressures. Consequently, a new cartridge 224 can be directly loaded into the chamber 308 without having to clean such chamber.

In this embodiment, the barrels 304, 306 and the chamber 308 can be made of heat treated 4340 steel, known in the art. Inside the projectile cartridge 224, the body portion 204 of the projectiles 230,232 can be made of heat-treated C300 maraging steel and contain PAX-11 as the explosive material, known in the art. The first combustible material 226 can be Reloder®-7 smokeless small rifle powder and the second combustible material comprising the alignment casing 222 can be a nitrocellulose impregnated fiber. The components of the tail-end portions 206 of the projectiles 230,232 can be 7075-T6 aluminum, known in the art, and the ignition charge 208 can be a PA520 electric primer, known in the art. The optional cap 202 can be polycarbonate or nylon, known in the art.

It is to be understood that the exemplary embodiments are merely illustrative of the present invention and that many variations of the above-described embodiments can be devised by one skilled in the art without departing from the scope of the invention.

For example, because a ball joint 216 is used in some embodiments, a variable degree of angling can be caused between the body portion 204 and the tail-end portion 206 of a projectile. Consequently, it can be seen that, although FIG. 3 illustrates an embodiment where the barrels 304, 306 diverge at an angle of three degrees, other angles can be used. Further, not all angles between projectiles need be the same. Some projectiles can diverge at one angle, others can diverge at another angle, and so on.

For another example, the figures herein illustrate a center projectile 230 surrounded by six peripheral projectiles 232. However, the invention is not limited to this particular arrangement of projectiles. For instance, the projectile cartridge 224 could house two projectiles, one that fires straight ahead and has a tail-end portion 206 like center projectile 230 in FIG. 2, and a second projectile that has a tail-end portion 206 like one of the peripheral projectiles 232 in FIG. 2 and fires in a diverging manner. Or, the projectile cartridge 224 can house a plurality of projectiles, some of which have a tail-end portion 206 like that of the center projectile 230 in FIG. 2, some of which have a tail-end portion 206 like that of a peripheral projectile 232 in FIG. 2, and some of which have some other sort of tail-end portion. Accordingly, it can be seen that a projectile cartridge can be produced that fires projectiles in any number of directional configurations.

For yet another example, although the figures show only one projectile (the center projectile 230) having a tail-end portion 206 with openings 218 and an ignition charge 208, the projectile cartridge 224 can have multiple projectiles having this tail-end portion configuration. Further, a tail-end portion 206 having the configuration of center projectile 230 need not have an ignition charge 208 therein. In these instances, an ignition charge 208 may be located elsewhere and pass along at least some of the energy caused by its combustion into the hollow region and through the openings 210 of such tail-end portion 206. Also, although the figures show that the projectile 230 having a hollow tail-end portion 206 with openings 210 and ignition charge 208 without a ball joint 216 and space 218, such a tail-end portion 206 can be included with a ball joint 216 and space 218 to allow angling of the corresponding body portion 204. In other words, the components of the tail-end portion 206 of one of the projectiles 232 and the components of the tail-end portion 206 of the projectile 230 can be combined to allow both angling and ignition in a single projectile.

For still yet another example, although the figures show that the alignment casing 222 encloses a portion of the tail-end portion 206 of the projectiles 230, 232, the alignment casing 222 can enclose more or less of such projectiles 230, 232. For instance, in embodiments where the ball joint 216 is not used in the projectiles 230, 232, the alignment casing 222 can enclose part of or all of the body portions 204, in addition to the tail-end portions 206.

For still yet another example, although the penetrating nose portions 212 are shown to be pointed herein, other shapes can be used. Similarly, the invention also is not limited to the particular shape or makeup of the body portions 204.

Further, it is described herein that energetic materials can be used for the ignition charge 208, the alignment casing 222, and within the body portion 204. The invention is not limited to the particular energetic materials used for these portions of the projectile cartridge 224, and the energetic materials can be the same or different amongst them.

Still further, the figures show a particular arrangement and shape of openings 210 through which combustion energy is distributed. However, other arrangements and shapes of such openings 210 can be used.

It is therefore intended that all such variations be included within the scope of the following claims and their equivalents.

PARTS LIST

100 Conventional Drilling Gun
102 Chamber of Conventional Drilling Gun
104 Combustible Cartridge of Conventional Drilling Gun
106 Magazine of Conventional Drilling Gun
108 Center Projectile of Conventional Drilling Gun
110 Peripheral Projectiles of Conventional Drilling Gun
112 Center Barrel of Conventional Drilling Gun
114 Peripheral Barrels of Conventional Drilling Gun
202 Cap
204 Body Portion
205 Cross-Sectional Area of Tail-end Portion
206 Tail-end Portion
207 Cross-Sectional Area of Body Portion
208 Ignition Charge
210 Opening
212 Penetrating Nose Portion
214 Hole in Tail-End-Most Surface of Alignment Casing
215 Boss Feature
216 Ball Joint
218 Space
220 Hole in Leading Surface of Alignment Casing
221 Leading Column Head Portion of Tail-End Portion
222 Alignment Casing
224 Projectile Cartridge
226 Interior Region of Alignment Casing
228 Distributed Energy

230 Center Projectile
232 Peripheral Projectile
234 Flange
300 Projectile System
302 Barrel System
304 Center Barrel
306 Peripheral Barrel
308 Chamber
402 Angle Between Body Portion and Tail-End Portion
404 Off-Centered
408 Webbing
410 Dividing Region

What is claimed is:

1. A projectile comprising:

a body portion comprising a penetrating nose portion; and a tail-end portion connected to the body portion, the tail-end portion having a smaller cross-sectional area than a cross-sectional area of the body portion, and the tail-end portion comprising openings that distribute energy passing through the tail-end portion from combustion of an ignition charge, wherein the tail-end portion comprises a ball joint upon which the body portion translates and pivots causing an angle between the body portion and the tail-end portion.

2. The projectile of claim 1, wherein the ignition charge is located within the tail-end portion.

3. The projectile of claim 1, wherein the body portion includes explosive material configured to detonate after impact of the body portion with an object subsequent to combustion of the ignition charge.

4. The projectile of claim 1, wherein the tail-end portion comprises a columnar shape.

5. The projectile of claim 1, further comprising a space in the body portion adjacent to the ball joint into which the ball joint becomes located when the body portion translates upon the ball joint.

6. The projectile of claim 5, wherein the body portion is centered on the ball joint when there is no angle between the body portion and the tail-end portion, and wherein, when the ball joint is in the space, the body portion is off-center with respect to the ball joint.

7. A projectile comprising:

a body portion comprising a penetrating nose portion;

a tail-end portion connected to the body portion, the tail-end portion having a smaller cross-sectional area than a cross-sectional area of the body portion, and the tail-end portion comprising openings that distribute energy passing through the tail-end portion from combustion of an ignition charge, the ignition charge located within the tail-end portion, wherein the tail-end portion comprises a ball joint upon which the body portion translates and pivots, causing an angle between the body portion and the tail-end portion.

8. The projectile of claim 7, further comprising a space in the body portion adjacent the ball joint into which the ball joint becomes located when the body portion translates upon the ball joint.

9. The projectile of claim 8, wherein the body portion is centered on the ball joint when there is no angle between the body portion and the tail-end portion, and wherein, when the ball joint is in the space, the body portion is off-center with respect to the ball joint.

10. The projectile of claim 7, wherein the body portion includes explosive material configured to detonate upon impact of the body portion with an object subsequent to combustion of the ignition charge.

11. The projectile of claim 7, wherein the tail-end portion comprises a columnar shape.

12. The projectile of claim 7, wherein a length of the projectile mostly is comprised of the body portion.

13. The projectile of claim 7, wherein the tail-end portion is located behind the body portion at a rear-most end of the projectile with respect to a forward direction in which the projectile is configured to travel.

14. The projectile of claim 12, wherein the tail-end portion is located behind the body portion at a rear-most end of the projectile with respect to a forward direction in which the projectile is configured to travel, such that a length of a portion of the projectile in the forward direction that translates and pivots upon the ball joint comprises most of the length of the projectile.

* * * * *